US005239717A

United States Patent [19]

Sue

[11] Patent Number: 5,239,717

[45] Date of Patent: Aug. 31, 1993

[54] PILLOW FOR ARM OF PERSON HOLDING A CHILD

[76] Inventor: Sue A. Sue, 22 Coquito Ct., Portola Way, Calif. 94028

[21] Appl. No.: 782,924

[22] Filed: Oct. 25, 1991

[51] Int. Cl.[5] ..... A47G 9/00; A41D 13/08

[52] U.S. Cl. ..... 5/655; 2/59; 2/104

[58] Field of Search ..... 5/431, 436, 434, 437, 5/443, 655, 636; 2/59, 104, 91, 208; D6/601

[56] References Cited

U.S. PATENT DOCUMENTS

| | | | |
|---|---|---|---|
| D. 315,845 | 4/1991 | Lafley | 5/434 |
| 3,657,741 | 4/1972 | Blanco | 2/59 |
| 4,393,520 | 7/1983 | Koch | 5/436 |
| 4,731,890 | 3/1988 | Roberts | 5/431 |
| 4,815,639 | 3/1989 | Lehman | 294/140 |
| 4,856,112 | 8/1989 | Effle | 2/59 |
| 4,884,297 | 12/1989 | Triche | 2/59 |
| 4,951,317 | 8/1990 | Gray et al. | 2/59 |

FOREIGN PATENT DOCUMENTS

| | | | |
|---|---|---|---|
| 1601773 | 10/1970 | France | 5/434 |

*Primary Examiner*—Alexander Grosz
*Attorney, Agent, or Firm*—Townsend and Townsend

[57] ABSTRACT

A pillow for a caretaker's arm for supporting the head of a baby. It cushions the caretaker's arm against the arm of a chair in which the caretaker is sitting while holding the baby. The baby's head can thus be properly supported in a comfortable manner yet the perspiration generated on the baby's head will be absorbed by the pillow rather than being placed in contact with the caretaker's arm. The pillow is tubular to receive a part of the arm of a caretaker. The material of the pillow also is yieldable to the touch. It can be of a standard size which will fit the arms of different caretakers. A typical length of the pillow is 7 to 14", the diameter of the pillow is 4 to 9", and a typical thickness of the pillow when collapsed in a flattened condition is about 1 to 3". The pillow can be made of any suitable material which is soft and which preferably can be washed so that the pillow can be used over and over again. The pillow forms a tube when it is expanded from a flattened condition. In a flattened, stored condition, the pillow is comprised of two side-by-side interconnected layers which lie flat and are juxtaposed relative to each other.

10 Claims, 2 Drawing Sheets

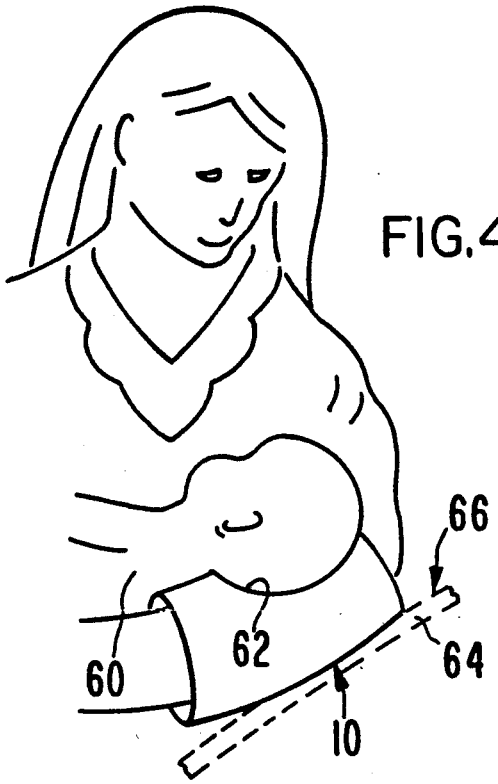
FIG.4
FIG.5
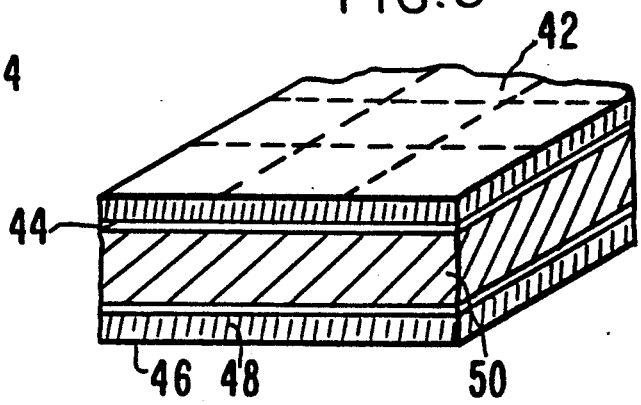
FIG.6
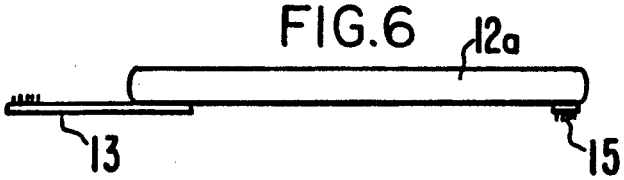
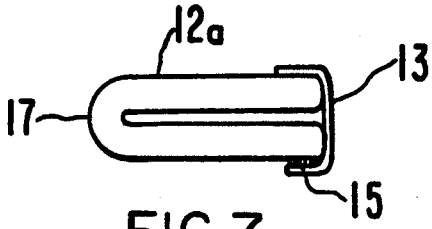
FIG.7

PILLOW FOR ARM OF PERSON HOLDING A CHILD

This invention relates to improvements in devices for adding to the comfort of a person holding an infant, a baby, or a young child and, more particularly, to a pillow which is soft and can be placed on the arm for supporting the head of a baby or infant.

BACKGROUND OF THE INVENTION

A caretaker of an infant, baby, or small child, hereinafter referred to as a baby, spends a lot of time comforting, rocking or nursing the baby. This is generally done while the caretaker is sitting in a chair, such as a rocking chair, with the head of the baby held against the caretaker's arm. The aforementioned actions can also be performed while the caretaker is standing. When performing these actions, the caretaker often becomes uncomfortable due to the weight of the baby's head against the caretaker's arm. This causes localized pressure on the arm, resulting in tension, sometimes swelling and abrasion to the caretaker's arm. Similar discomfort is experienced by the baby in and around its head, neck and shoulders and other parts of the body. While in a sitting position, the caretaker may experience other localized pressures created between the caretaker's arm the arm of a chair resulting in discomfort of greater or lesser degree depending upon the shape and hardness of the arm of the chair.

Since the caretaker of the baby must sit or remain in a fixed position for a relatively long time, extreme discomfort can be experienced by the caretaker. Because of this problem, attempts have been made to alleviate the discomfort to the caretaker and the baby. For instance, a blanket or ordinary head pillow have been used on the arm by being wrapped around the arm to cushion the weight of the baby's head and to alleviate the strain on the caretaker's arm when engaging the arm of the chair. However, these techniques are temporary at best, since the blanket or pillow tends to unwrap quickly due to arm movements of the caretaker and head movements of the baby. These movements cause the blanket and the pillow to become loose on the arm and they become essentially ineffective in reducing discomfort. Because of this drawback, the caretaker must continually readjust the position of the blanket or the pillow to its ideal position.

Another problem encountered in holding a baby during nursing or other activities is the accumulation of perspiration between the caretaker's arm and the baby's head. This perspiration, during hot weather for instance, can cause a bad skin condition on both the caretaker and the baby. Such a condition is clearly to be avoided if at all possible.

A reference related to pillows of this type is U.S. Pat. No. 4,731,890 which shows a sheath filled with polyester stable fiber and stitched out the outer periphery to close the perimeter of the sheath.

Because of the foregoing drawbacks and problems, it is desirable to have an improved head support for a baby which will be both comforting and satisfying to both baby and caretaker yet is convenient to use and is simple in construction.

SUMMARY OF THE INVENTION

The present invention provides a pillow for a caretaker's arm for supporting the head of a baby. The pillow provides comfort to the caretaker in that it cushions the head of the baby so as to minimize the discomfort to the caretaker's arm. It also cushions the caretaker's arm against the arm of a chair in which the caretaker is sitting while holding the baby. As a result, the caretaker can sit or stand for long periods of time with the arm supporting the head of the baby. The baby's head can thus be properly supported in a comfortable manner yet the perspiration generated on the baby's head will be absorbed by the pillow rather than being placed in contact with the caretaker's arm.

To this end, the pillow of the present invention is tubular to receive a part of the arm of a caretaker. The material of the pillow also is yieldable to the touch. It can be of a standard size which will fit the arms of different caretakers. A typical length of the pillow is 7 to 14", the diameter of the pillow is 4 to 9", and a typical thickness of the pillow when collapsed in a flattened condition is about 1 to 3".

The pillow itself can be made of any suitable material which is soft and which preferably can be washed so that the pillow can be used over and over again. It also is preferably of a non-slip material which will not cause skin problems on the baby's head or the caretaker's arm. The pillow forms a tube when it is expanded from a flattened condition so that the pillow, when expanded, presents somewhat of a cylindrical configuration; whereas, in a flattened, stored condition, the pillow is comprised of two side-by-side interconnected layers which lie flat and are juxtaposed relative to each other. When it is desired to use the pillow, the two layers are separated to expand the pillow to form the center space or hole in the pillow for receiving the caretaker's arm.

The material which may be used can be selected from any one of a number of different types of materials. For instance, the material can be two outer layers of quilted material each having an inner layer of synthetic, cotton-like material bonded, such as adhesively bonded or by stitching, to the inner surfaces of the outer layers, following which a foam layer or a layer of batting can be inserted between the inner layers. The material is preferably washable. Other materials can be used if desired.

The primary object of the present invention is to provide a tubular, open end pillow for placement on the arm of a caretaker for supporting a baby's head on the arm in a comfortable manner, yet the pillow will absorb perspiration and will cushion the arm of the caretaker from discomfort due to engagement with the arm of a chair in which the caretaker is sitting while holding the baby.

Other objects of the present invention will become apparent as the following specification progresses, reference being had to the accompanying drawings for an illustration of several embodiments of the invention.

BRIEF DESCRIPTION OF THE INVENTION

FIG. 4 is an elevational view of a baby's head resting on a pillow when the pillow is on the arm of a caretaker;

FIG. 5 is an enlarged, fragmentary perspective view of a piece of material suitable for making the pillow; and FIGS. 6 and 7 are end elevation views of another embodiment of the pillow.

DESCRIPTION OF THE PREFERRED EMBODIMENT

Figure 1:
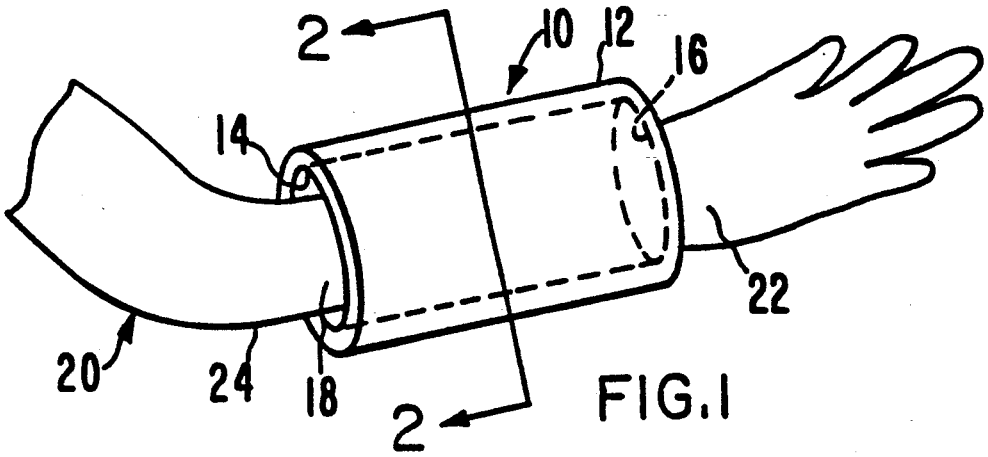
FIG. 1 is a schematic side elevational view of a preferred embodiment of the pillow of the present invention mounted on the arm of a caretaker.

The preferred embodiment of the pillow of the present invention is broadly denoted by the numeral 10 and includes a pillow body 12 of soft, flexible, pliant material, such as a cotton fabric, which is provided with some cushioning material such as synthetic foam material or batting which can be of different grades and qualities.

Pillow body 12 has a pair of open ends 14 and 16 to present a generally circular or elliptical cross section when the pillow is expanded. The pillow is to be fitted over the arm 18 of a user 20, such as a nurse, mother, caretaker or the like. The pillow typically extends from the wrist area 22 to the elbow area 24 of the arm of the caretaker 20. To this end, the pillow has a length in the range of 7 to 14", preferably 10" in length. It has a diameter in the range of 4 to 9", preferably 6" in diameter and a thickness of 1 to 3", preferably 1¼" thick. A 10" length for the pillow body 12 is adequate to cover the arm of an average size caretaker and to provide ample outside area on the outer surface of a pillow body 12 for resting a baby's head. The 6" diameter allows for adequate room of an average sized arm of a caretaker. The 1" thickness dimension for pillow body 12 provides adequate cushioning for the baby's head.

Figure 2:
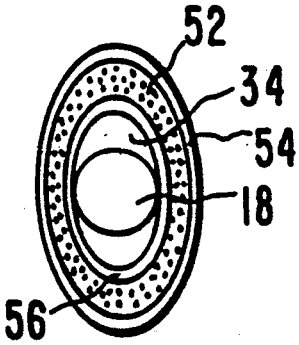
FIG. 2 is a cross sectional view taken along line A—A of FIG. 1.
Figure 3:
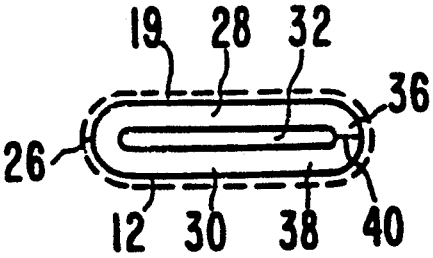
FIG. 3 is a view showing a flattened condition of the pillow, such as when the pillow is stored and not in use.

The preferred embodiment of the invention is made by providing a sheet of suitable material, such as a quilted fabric of the type shown in FIG. 5. The sheet is folded over upon itself about one end 26 (FIG. 3) until the two layers 28 and 30 of the pillow body are side-by-side with respect to each other and present a slit 32 which, when expanded, forms the central or elliptical hole 34 (FIG. 2) for receiving the arm 18 of the caretaker 20. The opposite ends 36 and 38 of the sheet are stitched along line 40 (FIG. 3) so as to effectively make the sheet into a tube which can be stored in a flattened condition (FIG. 3) when the pillow is not in use.

An alternate way of forming the pillow 10 is to provide a sheet **12*a* (FIG. 6) and to provide a pair of spaced hook and loop type strips 13 and 15 at the ends of the sheet 12*a* as shown in FIG. 6. When the sheet is folded in the middle about the area denoted by the numeral 17 (FIG. 7) the sheet assumes the configuration shown in FIG. 3, following which the hook and loop type strips 13 and 15 are releasably connected together so as to form the tubular pillow body. The pillow is then ready for use in the same manner as that described above with respect to the pillow 10 (FIG. 3**).

The material for making the pillow 10 is of any suitable type. Preferably, the type selected for making the pillow is shown in FIG. 5 in which a quilted fabric, outer layer 42 of cotton or the like has a synthetic cotton-like inner layer 44 bonded thereto in any suitable manner. A similar outer layer 46 has a cotton-like inner layer 48 mounted to the inner surface thereof. A layer 50 of foam plastic material which is soft, pliable, washable and flexible is between the two inner layers 44 and 48 to provide the thickness for the pillow. In place of foam material 50, a layer of batting material can be used, such batting material being soft, flexible, cotton-like and bendable can be used.

In all cases, it is preferred that the material be absorbent to absorb the perspiration of the caretaker's arm as well as the perspiration from the head of the baby. Also, sponge rubber or other synthetic sponge material 52 (FIG. 2) could be used within layers 54 and 56 to provide an optimum absorption from the baby or from the caretaker's arm.

It is intended that pillow 12 be provided and used over and over again for a particular baby. However, in other settings, such as in a hospital nursery, the pillow 12 can be provided with an outer protective sleeve 19 shown in dashed lines in FIG. 3 for rendering the pillow sanitary for use by different babies. The sleeve could be tubular or could have hook and loop type straps in the manner shown in FIGS. 6 and 7. After each use, the sleeve 19 can be thrown away or thrown into the bag with other sleeves for washing.

Figure 1A:
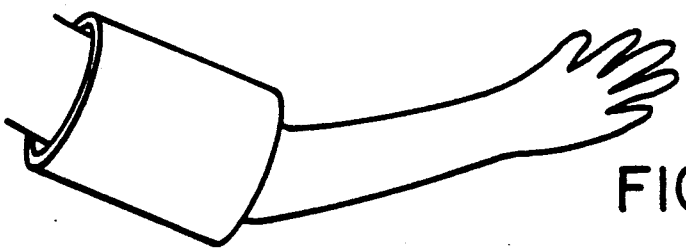
FIGS. 1A and 1B are views similar to FIG. 1 but showing other embodiments of the pillow.
Figure 1B:
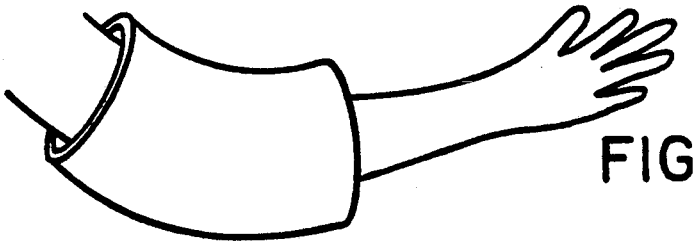

FIGS. 1A and 1B show several other embodiments of the pillow. The embodiment of FIG. 1A is for the upper arm and the embodiment of FIG. 1B is for the elbow.

In use, pillow 10 is placed on the arm of the caretaker in the manner shown in FIG. 1. The caretaker can adjust the location of the pillow 10 on the arm so as to render the pillow most comfortable for use.

The caretaker rests the head of a baby 60 on the pillow 10 as shown in FIG. 4 so that the baby's head is supported from beneath and the softness of the material of pillow 10 causes a concavity 62 to be formed in the pillow which keeps the baby's head out of direct contact with the caretaker's arm. Moreover, the pillow 10 keeps the caretaker's arm out of direct contact with the arm 64 of a chair 66 in which the caretaker is sitting while holding the baby 60. The caretaker can either comfort, rock or nurse the baby while in this position. Moreover, when the arm gets tired from holding the baby in one position, the baby can be shifted to the other arm after the sleeve has been removed from the first arm and then placed on the second arm. Thus, the pillow of the present invention is reversible for use on both arms and either end of the pillow can be near the elbow of either arm of the caretaker.

Pillow 10 of the present invention provides a head support for a baby that will not slip off the baby's head or off the caretaker's arm. The pillow provides comfort to the caretaker and the baby simultaneously and the pillow can be used for indoor or outdoor use while providing a decorative support suitable for use for any occasion.

I claim:

1. A pillow for adding comfort to a baby's head supported on an arm of a caretaker comprising:

a tubular pillow body having a pair of opposed, open ends, a length, and a circumferential extent, said body adapted to receive the arm and to extend along at least a portion of the arm, said pillow body having an outer surface for engaging a baby's head when the baby is held by a caretaker and while the pillow body is on the arm of a caretaker, the pillow body being formed from a moisture absorbent cushioning material which is relatively soft and depressible to provide comfort to the caretaker and the baby, the cushioning material extending throughout the length and the circumferential extent of the body the length of the pillow being in the range of 7 to 14", the inside diameter being in the range of 4 to 9", and the thickness of the pillow being in the range of 1 to 3", the pillow body including a sheet of material having a pair of opposed ends and being folded upon itself, said pillow body being stitched to interconnect said ends and form the tubular configuration for the body, the pillow adapted to absorb perspiration from a baby's head and a caretaker's arm.

2. A pillow as set forth in claim 1, wherein said material of the pillow body is a cotton outer layer with an inner layer of soft material coupled to the cotton outer layer.

3. A pillow as set forth in claim 2, wherein said inner layer comprises a foam material layer.

4. A pillow as set forth in claim 2, wherein said inner layer is a batting material.

5. A pillow as set forth in claim 1, wherein said body has a filler material comprised of a layer of synthetic foam material.

6. A pillow as set forth in claim 1, wherein said body has a filler material comprised of a layer of batting material.

7. A pillow as set forth in claim 1, wherein sleeve means is removably mounted on the pillow body to form a sanitary, replaceable cover therefor.

8. A pillow as set forth in claim 1, wherein the pillow body is adapted for placement on the forearm.

9. A pillow as set forth in claim 1, wherein the pillow body is adapted for placement on the elbow.

10. A pillow as set forth in claim 1, wherein the pillow body is adapted for placement on the upper arm.

* * * * *